United States Patent [19]

Kip et al.

[11] 4,308,530

[45] Dec. 29, 1981

[54] DETECTION SYSTEM FORMING WIDE GATES WITH SUPERIOR SPATIAL SELECTIVITY

[75] Inventors: Harm J. Kip, Lichtenvoorde; Tallienco W. H. Fockens, Eibergen; both of Netherlands

[73] Assignee: N.V. Nederlandsche Apparatenfabriek NEDAP, Groenlo, Netherlands

[21] Appl. No.: 904,416

[22] Filed: May 10, 1978

[30] Foreign Application Priority Data

Jul. 19, 1977 [NL] Netherlands ..... 7708012

[51] Int. Cl.[3] ..... G08B 13/24

[52] U.S. Cl. ..... 340/572; 340/551

[58] Field of Search ..... 340/572, 551; 343/6.8 R, 6.8 LC

[56] References Cited

U.S. PATENT DOCUMENTS

| | | | |
|---|---|---|---|
| 3,631,442 | 12/1971 | Fearon | 340/572 |
| 3,665,449 | 5/1972 | Elder et al. | 340/572 |
| 3,686,564 | 8/1972 | Mallick, Jr. et al. | 340/551 |
| 3,696,379 | 10/1972 | Minasy | 340/572 |
| 3,707,711 | 12/1972 | Cole et al. | 340/572 |
| 3,765,007 | 10/1973 | Eider | 340/572 |
| 3,798,642 | 3/1974 | Augenblick et al. | 340/572 |
| 3,868,669 | 2/1975 | Minasy | 340/572 |
| 3,895,368 | 7/1975 | Gordon et al. | 340/572 |
| 4,135,184 | 1/1979 | Pruzick | 340/572 |

FOREIGN PATENT DOCUMENTS

| | | |
|---|---|---|
| 2101879 | 7/1972 | Fed. Rep. of Germany . |
| 6804325 | 10/1968 | Netherlands . |
| 1254571 | 11/1971 | United Kingdom . |

*Primary Examiner*—Glen R. Swann, III

*Attorney, Agent, or Firm*—Fleit & Jacobson

[57] ABSTRACT

A detection system comprises at least one gate including transmitter means for forming a magnetic field and receiver means for receiving a signal transmitted by a detecting wafer provided with an oscillating circuit, wherein each gate comprises at least two spatial detection zones.

26 Claims, 10 Drawing Figures

DETECTION SYSTEM FORMING WIDE GATES WITH SUPERIOR SPATIAL SELECTIVITY

BACKGROUND OF THE INVENTION

1. Field of the Invention

This invention relates to a detection system that can be used for detecting and possibly identifying persons, cattle or goods moving through a pre-determined zone. Such a system normally comprises a number of gates provided with means for generating a magnetic field, and each forming a detection zone for detecting wafers having electrical oscillating circuits embedded therein. The wafers are carried by the persons to be detected or are attached to the goods to be detected or the cattle to be detected.

2. Description of Prior Art

A disadvantage of prior systems is that, for example, when they are used as anti-theft systems for shops, but also with other applications, the gates should be rather narrow for effective, spatially determined detection. In prior systems, use is made of gates approximately 1 m wide. If wider gates were used, it would be possible for two or more persons to move through the gate at the same time. If one of these persons carries an article provided with a wafer with an oscillating circuit; it is almost impossible to determine which person is carrying the safeguarded article, in other words, the spatial selectivity of the prior systems is poor. Furthermore, relatively narrow gates form obstacles in passageways, such as entries and exits of shops, which may be objectionable in connection with fire regulations.

SUMMARY OF INVENTION

It is an object of the present invention to overcome these disadvantages.

According to the present invention, therefore, there is provided a detection system comprising at least one gate including transmission means for forming a magnetic field and receiving means for receiving a signal transmitted by a detection wafer provided with an oscillating circuit, characterized in that each gate comprises at least two spatial detection zones.

BRIEF DESCRIPTION OF DRAWINGS

Some embodiments of the invention will now be described, by way of example, with reference to the accompanying drawings. In said drawings.

DETAILED DESCRIPTION

Figure 1:
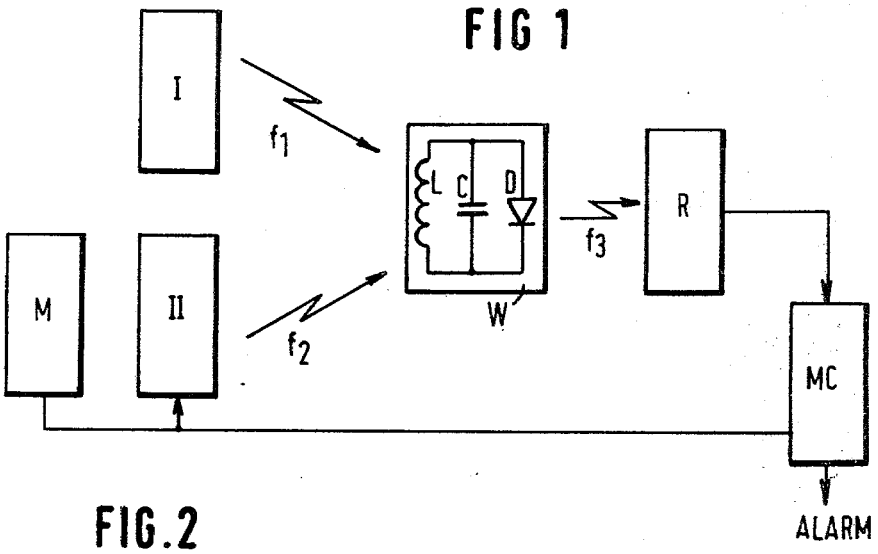
FIG. 1 is a diagrammatic illustration of a detection system to which the present invention relates.

Referring to the drawings, the system shown in FIG. 1 comprises a first transmitter I and a second transmitter II. The first transmitter transmits a signal having a frequency $f_1$, and the second transmitter transmits a signal having a frequency $f_2$. Both signals can be received by a detection wafer W. Wafer W comprises a resonance circuit with a coil L, a capacitor C, and a non-linear element D, which for example may be a diode.

Furthermore the system comprises a receiver R, capable of actuating an alarm device upon the receipt of a signal having a predetermined frequency. In order that the chance of a false alarm may be limited, one of the transmitted signals may be modulated, for example, in amplitude, and the signal received may be checked for the condition that it comprises this modulation before the alarm device is actuated. Thus FIG. 1 shows a modulator M, which is connected to transmitter II and to a modulation checking device MC, to which the output signal from receiver R is also supplied. The output of the modulation checking device is connected to an alarm device.

Figure 2:
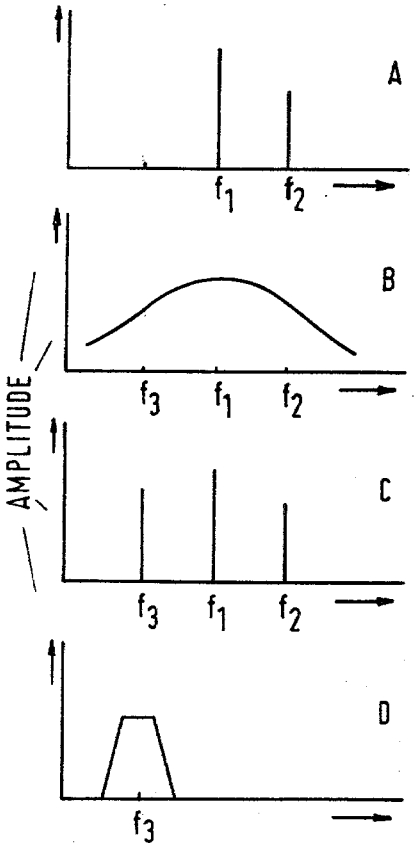
FIG. 2 shows some frequency spectrums in illustration of the system shown in FIG. 1.

In illustration of the operation of the system of FIG. 1, FIG. 2 shows some frequency spectrums. Part A of FIG. 2 shows the relative positions of frequencies $f_1$ and $f_2$, transmitted by transmitters I and II, respectively. FIG. 2A also shows that the amplitude of the signals of frequency $f_1$ is larger than that of the signals having frequency $f_2$.

Part B of FIG. 2 shows the resonance curve of the oscillation circuit in detection wafers W. The resonance frequency is $f_1$, but the location of $f_2$ is such that the attenuation of the resonance circuit at $f_2$ is not yet very large.

Part C of FIG. 2 shows the frequencies re-transmitted by the detection wafers W when these are in the field of transmitters I and II. In addition to frequencies $f_1$ and $f_2$, a third frequency $f_3$ is transmitted, given by $f_3=2f_1-f_2$. Frequency $f_3$ is formed as a result of the nonlinear element D. Frequencies $f_1$ and $f_2$ have been so selected that the amplitude curve of the oscillation circuit at $f_3$ has not yet decreased very much relative to the value at $f_1$.

Part D of FIG. 2, finally, shows the frequency response curve of receiver R. The frequency response curve shows that the receiver is only responsive to signals having frequency $f_3$ or a frequency that is very slightly different from $f_3$.

The system described above requires coils for the formation of magnetic fields to which a detection wafer can react. For each frequency a separate coil may be used, so that a gate has three coils, i.e. two transmitter coils and one receiver coil. It is also possible, however, to use coils combined for two or even three signals. In prior systems a gate often comprises one horizontal coil, e.g. in the bottom of the gate, and one or more vertical coils. The width of the gate is here dictated by the dimensions of the horizontal coil. If, however, the horizontal coil is made very wide, there is no longer any spatial selectivity whatsoever.

In order to overcome this disadvantage, according to the present invention a plurality of side-by-side coils are used in each gate.

Figure 3:
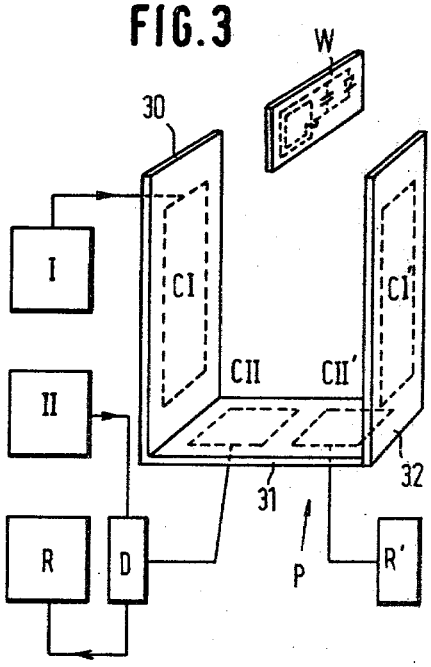
FIG. 3 shows a first embodiment of a system according to the present invention.

FIG. 3 shows a first embodiment of a detection system according to the present invention. A transmitter I energizes an associated transmitter coil CI. Transmitter coil CI is accommodated in the sidewall 30 of a gate P. Installed in the bottom 31 of gate P is a coil CII, which is energized by a second transmitter II. In this example, coil CII also serves as a receiver coil, for which purpose it is coupled to a receiver R. Connected between coil CII, on the one hand, and transmitter II as well as receiver R is a terminating set D, which in a suitable manner separates transmission signals and reception signals. Lying next to coil CII in the bottom of the gate is a second coil CII'. This coil CII' is connected to a separate receiver R'. Furthermore a vertical transmitter coil CI' is accommodated in the other sidewall 32 of the gate. Coils CI' and CII' may be energized by transmitters I and II, respectively, or by separate transmitters. In this way two detection fields are generated within the gate. If a detection wafer W is over coil CII, an alarm signal will be given by receiver R, and if a detection wafer W is over coil CII', an alarm signal will be given by receiver R'.

It is clear that a gate constructed in this way can be twice as wide as a conventional gate.

It is noted that the vertical coils could be used as transceiver coils and the horizontal ones as transmitter coils.

Figure 4:
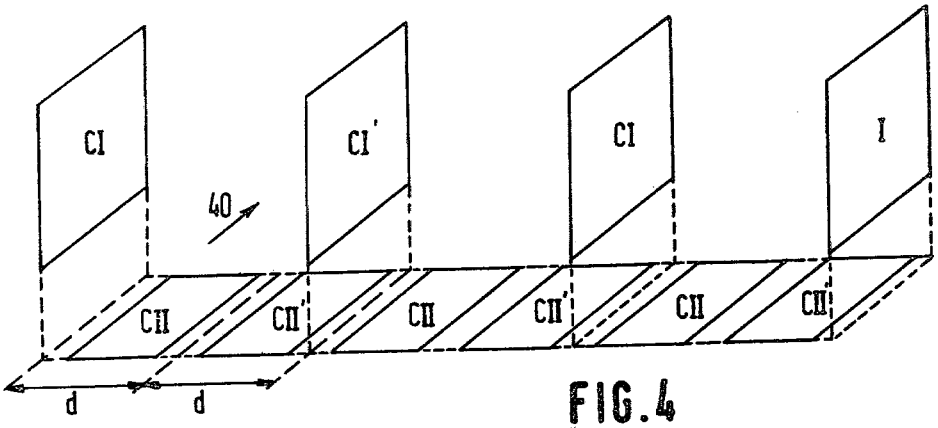
FIG. 4 shows an extension of the system shown in FIG. 3.

FIG. 4 shows diagrammatically in what way a plurality of gates as shown in FIG. 3 can be arranged in side-by-side relationship. Arrow 40 indicates the direction of movement of the detection wafers; in the case of an anti-theft system for shops, this is the direction of travel of customers leaving the shop.

Figure 5:
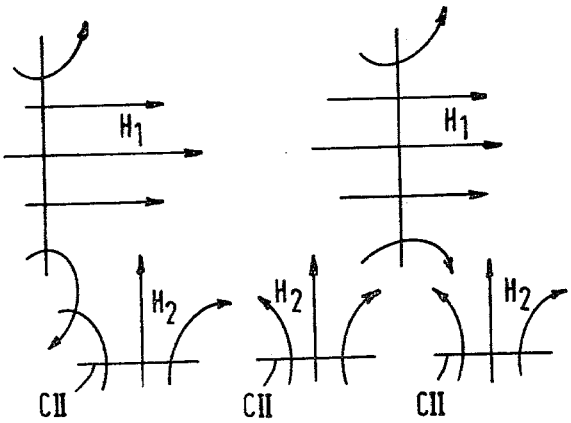
FIG. 5 shows the configuration of the magnetic fields in the system of FIG. 4.

FIG. 5 diagrammatically shows the configuration of the magnetic fields generated. The fields of coils CI and CI' are designated by $H_1$, and the fields of coils CII and CII' are designated by $H_2$.

Although the combined transceiver coils CII and CII' are all shown to be lying in the floor of a gate in the accompanying drawings, these transceiver coils may just as well be mounted in the ceiling of a gate. A combination of coils in the ceiling and coils in the floor is also possible. Such a combination is recommended if good detection is necessary at different levels. Furthermore, the transceiver coils may be placed in off-set relationship.

Figure 6:
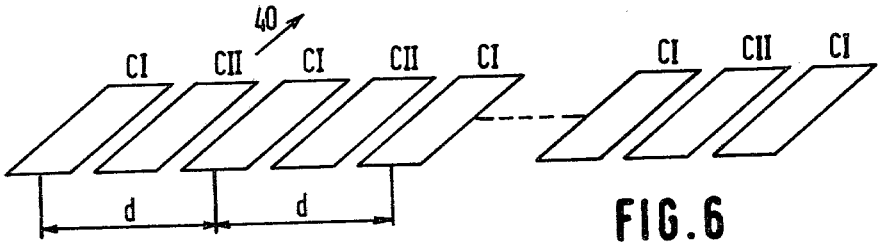
FIG. 6 shows a different embodiment of a system according to the present invention.

FIG. 6 shows a different embodiment of the inventive idea. All coils are here disposed in one horizontal plane, including those exclusively serving as transmitting coils. All transmitting coils CI, forming a magnetic field $H_1$ with a frequency $f_1$, can be connected to one single transmitter. All coils CII, serving both to generate a magnetic field $H_2$ with a frequency $f_2$ and to detect a signal with a frequency $f_3$ generated by a detection wafer W, can also be connected to one single transmitter. Coils CII should, however, be connected each to a separate receiver. In this manner any given number of detection units d can be formed side by side, without vertical partitions being required.

Figure 7:
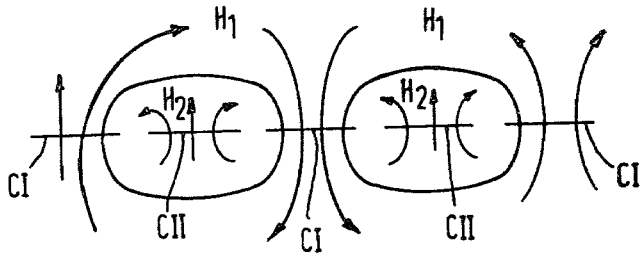
FIG. 7 shows the configuration of the magnetic fields in the system shown in FIG. 6.

FIG. 7 shows the configuration of the magnetic fields formed by coils CI and CII for two detection units. Two coils CI together form a magnetic field, the field lines of which entirely enclose the intermediate coil CII. In this configuration the magnetic coupling between coils CI, on the one hand, and coil CII, on the other, is minimal.

In this configuration of the transmitter coils and the transceiver coils, too, the coils may be mounted in the floor, in the ceiling, or both, and if desired in off-set relationship in the direction of travel. It is noted that, in all embodiments described, means may be provided for comparing the intensity of signals received by adjacent receiving coils, in order that, in boundary cases, the position of the detection wafer may be determined more accurately.

For the same purpose, it is possible for the signals supplied to adjacent transceiver coils to be given a different code, for example, by means of amplitude modulation, and for the receivers concerned to be provided with detectors for the codes concerned.

All of the above-described embodiments of the invention employ two or more horizontal coils. This may be objectionable under certain circumstances, owing to spurious signals being generated by piping and wiring mounted in the floor or ceiling of the building, or the reinforcement of a concrete building.

A first possibility of overcoming this drawback consists in the use of electrically conductive screens between the coils concerned and the spurious sources in the surroundings. Such screens are effective to spatially confine and separate the detection field and the spurious field.

A second possibility of overcoming the drawback outlined above is to use vertical coils only, between which two detection zones lie next to each other. If desired, this solution may be combined with the use of electrically conductive screens for partitioning the fields of adjacent gates.

Figure 8:
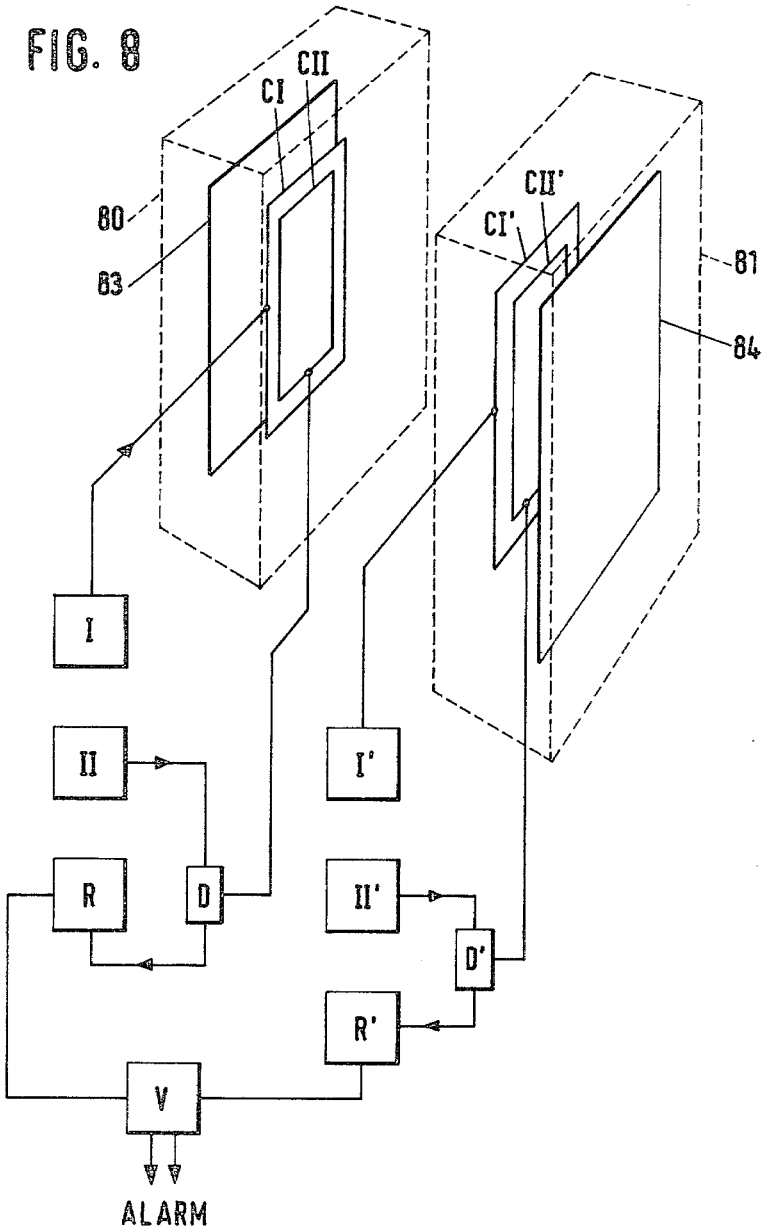
FIG. 8 shows still another embodiment of a gate of a system according to the present invention.

This arrangement is shown in FIG. 8.

FIG. 8 shows two pillars 80 and 81, each accommodating a pair of coils CI, CII and CI', CII', respectively, located one within the other. Similar to the embodiments described earlier, coils CI and CI' are connected to transmitter I and I', respectively, and coils CII and CII' are connected to transmitters II and II', respectively. Coils CII and CII' further serve as receiving coils for the signal transmitted by a detection wafer, for which purpose they are connected via terminating sets D and D', respectively, receivers R and R', respectively. In order to ensure good spatial selectivity, a comparator circuit V is used for comparing the intensity of the signals received by receivers R and R' to determine whether the detection wafer is on the left or the right in the gate.

Furthermore there are shown electrically conductive screens 83 and 84, which confine the fields generated to the space defined between pillars 80 and 81. In this way a plurality of gates can be placed side by side without the occurrence of any cross-effects.

It is also possible to use only one coil in each pillar, to which both transmission signals are supplied via a multiplex device, and which also serves as a receiving coil.

Figure 9:
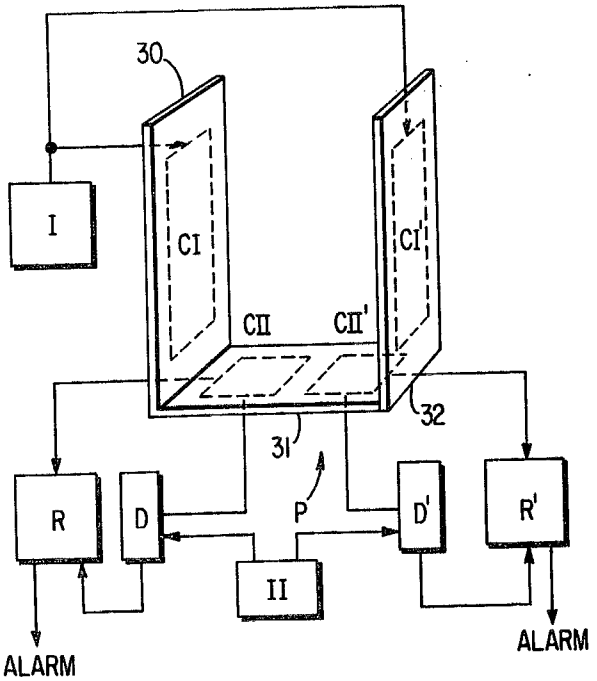
FIG. 9 shows a variation of the first embodiment of FIG. 3.

FIG. 9 shows a variation of the first embodiment of FIG. 3. Specifically, in FIG. 9, the transmitter coils CI and CI' are connected to a single first transmitter I, with adjacent transceiver coils CII and CII' being connected through different coding devices D and D' (for effecting coding) to a second transmitter II, each of the transceiver coils CII and CII' being connected to a separate receiver R and R', respectively, capable of recognizing the coding effected by the coding device.

Figure 10:
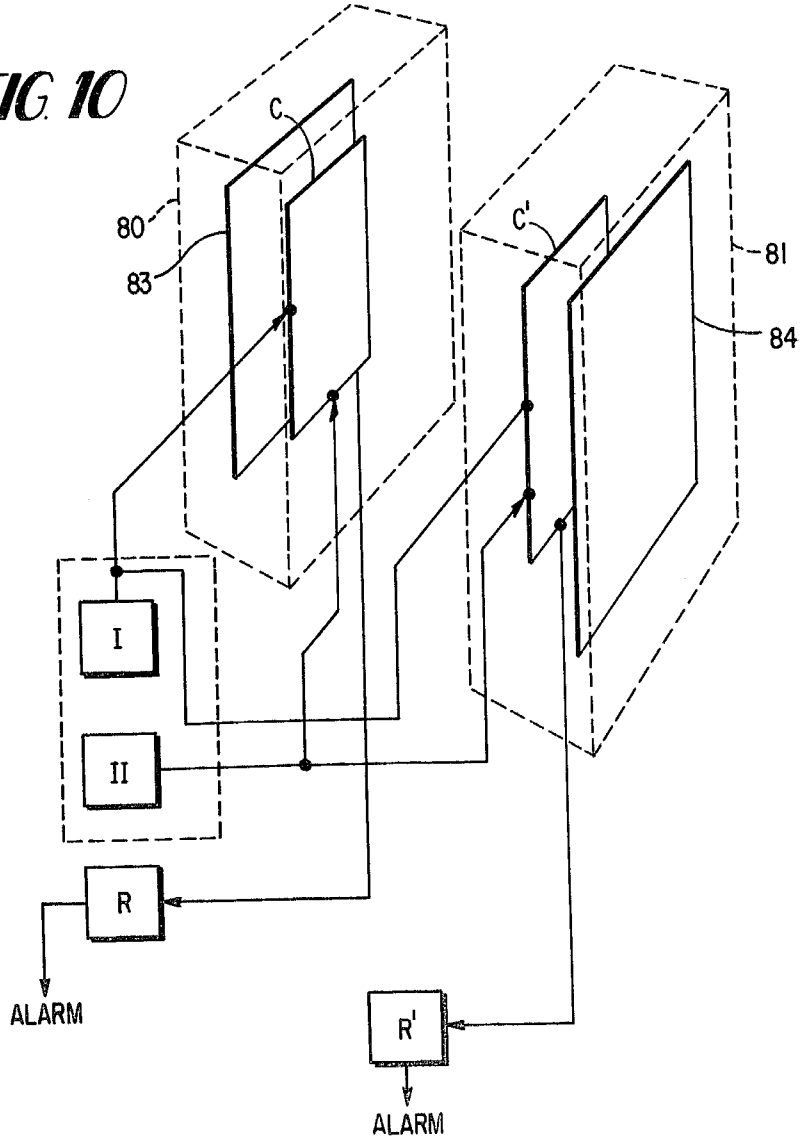
FIG. 10 shows a variation of the embodiment of FIG. 8.

FIG. 10 shows a variation of the embodiment of FIG. 8. As seen in FIG. 10, left-hand transmitter and transceiver coils (CI and CII, respectively, in FIG. 8) and right-hand transmitter and transceiver coils (CI' and CII', respectively, in FIG. 8) are combined to form respective single coils C and C' (FIG. 10), to which two transmission frequencies are supplied by separate transmitters I and II, respectively. Moreover, the coils C and C' are connected to corresponding receivers R and R', respectively.

Various modifications of the embodiments described will readily occur to those skilled in the art without departing from the scope of the present invention.

We claim:

1. A detection system comprising at least one gate including:

transmitter means for transmitting a first signal, detection wafer means for receiving said first signal and responsive thereto for retransmitting said first signal to provide a second signal, and receiver means for receiving said second signal retransmitted by said detection wafer means, said detection wafer means including an oscillating circuit;

wherein each said at least one gate comprises at least two spatial detection zones directly adjoining one another with no barrier therebetween.

2. A detection system according to claim 1, wherein each said at least one gate has a left-hand sidewall incorporating a first transmitter coil, and a right-hand sidewall incorporating a second transmitter coil, and comprising transceiver coils provided in two adjacent zones in at least one substantially horizontal plane between said left-hand sidewall and said right-hand sidewall.

3. A detection system according to claim 1, wherein each said at least one gate has a left-hand sidewall incorporating a first transceiver coil, and a right-hand sidewall incorporating a second transceiver coil, and comprising transmitter coils provided in two adjacent zones in at least one substantially horizontal plane between the sidewalls.

4. A detection system according to claim 1, wherein each said at least one gate comprises at least three transmitter coils disposed in alternation with transceiver coils in at least one substantially horizontal plane.

5. A system according to claim 1, wherein each said at least one gate comprises a left-hand sidewall incorporating a first transmitter coil and a first transceiver coil, and a right-hand sidewall incorporating a second transmitter coil and a second transceiver coil, each of said transceiver coils being connected to a corresponding receiver.

6. A system according to claim 4, wherein all transmitter coils are connected to a single first transmitter, adjacent transceiver coils being connected through different coding devices for effecting coding to a second transmitter, and each of said transceiver coils being connected to a separate receiver capable of recognizing the coding effected by the coding device.

7. A system according to claim 5, further comprising means for comparing, one with the other, the intensity of signals received by adjacent ones of said transceiver coils.

8. A system according to any one of claims 2 through 4, wherein the coils lying in the at least one substantially horizontal plane are situated in off-set relationship to one another in adjacent zones.

9. A system according to any one of claims 2 through 4, wherein each said at least one gate has a substantially horizontal bottom plane and a substantially horizontal ceiling plane, there being at least one coil in each of said substantially horizontal bottom and ceiling planes.

10. A system according to claim 9, wherein the coils in the substantially horizontal bottom plain are disposed in off-set relationship to the coils in the substantially horizontal ceiling plane.

11. A system according to claim 5, further comprising an electrically conductive screen disposed on one side of at least one of said left-hand and right-hand sidewalls.

12. A system according to claim 1, wherein each said at least one gate comprises a left-hand, vertically directed arrangement of transmitter and transceiver coils and a right-hand, vertically directed arrangement of transmitter and transceiver coils so as to form two detection fields in the intermediate area.

13. A system according to claim 12, wherein the left-hand transmitter and transceiver coils and the right-hand transmitter and transceiver coils are each combined to form respective single coils to which two transmission frequencies are supplied for transmission and which are also connected to a receiver.

14. A system according to claim 12, further comprising an electrically conductive screen disposed on that side of the transmitter and transceiver coils remote from the detection zone.

15. A system according to claim 12, wherein each said transmitter coil is connected to a corresponding first transmitter, each said transceiver coil being connected to a corresponding receiver.

16. A system according to claim 12, wherein a transmission signal is supplied to each said transceiver coil via a coding device of its own, and each transceiver coil is connected to a separate receiver capable of recognizing the coding.

17. A system according to claim 15, further comprising comparator means for comparing the intensities of the signals received by the transceiver coils of said at least one gate.

18. A system according to claim 1, wherein the oscillating circuit of the detection wafer means has a reasonance range and a resonance frequency coinciding essentially with a first frequency ($f_1$) transmitted in a given detection zone; a second frequency ($f_2$) simultaneously transmitted in each detection zone being in the vicinity of the first frequency ($f_1$) and well within the resonance range of the oscillating circuit; a non-linear element being connected to the oscillating circuit, said non-linear element being capable of forming a third frequency ($f_3$) also within the reasonance range of the oscillating circuit, but on the other side of the first frequency ($f_1$) from the second frequency ($f_2$).

19. A system according to claim 18, wherein the non-linear element is a semiconductor diode.

20. A system according to any one of claims 18 and 19, wherein the second frequency ($f_2$) is higher than the first frequency ($f_1$), and the third frequency ($f_3$) formed by the non-linear element being equal to twice the first frequency ($f_1$) minus the second frequency ($f_2$).

21. A system according to any one of claims 18 and 19, wherein the oscillating circuit comprises a coil and a capacitor.

22. A system according to any one of claims 18 and 19, wherein the oscillating circuit and the non-linear element form an integrated circuit embedded in the detection wafer means.

23. A system according to claim 13, further comprising an electrically conductive screen disposed on that side, remote from the detection zone, of each of the respective single coils.

24. A system according to claim 13, wherein each said respective single coil is connected to a corresponding first transmitter and to a corresponding receiver.

25. A system according to claim 13, wherein a transmission signal is supplied to each of said respective single coils via a coding device of its own, and each of said respective single coils is connected to a separate receiver capable of recognizing the coding.

26. A system according to claim 25, further comprising comparator means for comparing the intensities of the signals received by the respective single coils.

* * * * *